US008231306B2

(12) United States Patent
Trümpi

(10) Patent No.: US 8,231,306 B2
(45) Date of Patent: Jul. 31, 2012

(54) ADVANCEMENT OF PIPE ELEMENTS IN THE GROUND

(76) Inventor: Stefan Trümpi, Ennenda (CH)

( * ) Notice: Subject to any disclaimer, the term of this patent is extended or adjusted under 35 U.S.C. 154(b) by 611 days.

(21) Appl. No.: 10/598,132

(22) PCT Filed: Feb. 17, 2005

(86) PCT No.: PCT/CH2005/000090

§ 371 (c)(1),
(2), (4) Date: May 31, 2007

(87) PCT Pub. No.: WO2005/080753

PCT Pub. Date: Sep. 1, 2005

(65) Prior Publication Data

US 2007/0280786 A1 Dec. 6, 2007

(30) Foreign Application Priority Data

Feb. 19, 2004 (CH) ..... 0271/04

(51) Int. Cl.
*E21D 9/093* (2006.01)

(52) U.S. Cl. ..... 405/175; 175/62; 254/29 R

(58) Field of Classification Search ..... 405/174, 405/175; 175/62; 254/29 R
See application file for complete search history.

(56) References Cited

U.S. PATENT DOCUMENTS 3,388,724 A * 6/1968 Mascenik et al. ..... 138/149
3,881,776 A * 5/1975 Fashbaugh et al. ..... 299/31
4,095,435 A * 6/1978 Uemura ..... 405/135
4,095,655 A * 6/1978 Still ..... 175/19
4,432,667 A * 2/1984 Richardson ..... 405/143
4,662,606 A * 5/1987 Akesaka ..... 254/29 R
4,718,459 A * 1/1988 Adorjan ..... 405/172
4,936,709 A * 6/1990 Kimura ..... 405/184
7,181,821 B2 * 2/2007 Anderson et al. ..... 29/507

FOREIGN PATENT DOCUMENTS

CH 574023 A5 * 3/1976

* cited by examiner

*Primary Examiner* — Tara Mayo-Pinnock
(74) *Attorney, Agent, or Firm* — Thaddius J. Carvis

(57) ABSTRACT

The aim of the invention is to advance pipe elements (18) for constructing an elongate structure in a soft, stony, rocky, and/or monolithic ground. Said aim is achieved by determining the force of advancement (40), the eccentricity (52) thereof in relation to the neutral axis (N), and/or the direction of advancement (28) with the aid of a pressing device (24) and extension elements (44) which are filled with fluid and are disposed on the face of the joints (70) of the tubing (14). The fluid pressure (p) is measured in at least one portion of the extension elements (44) which extends along the entire length of the tubing (14), and/or the deformation is measured in some of the joints (70). The force of advancement (40) and the eccentricity (52) are calculated from said parameters, and the values are stored and/or are compared to stored standard values. According to a variant, the eccentricity (52) is calculated, and the values are converted into control commands for the pressing device (24) and/or the individual fluid supply to or the individual fluid discharge from the extension elements (44).

14 Claims, 4 Drawing Sheets

ADVANCEMENT OF PIPE ELEMENTS IN THE GROUND

Figure 1:
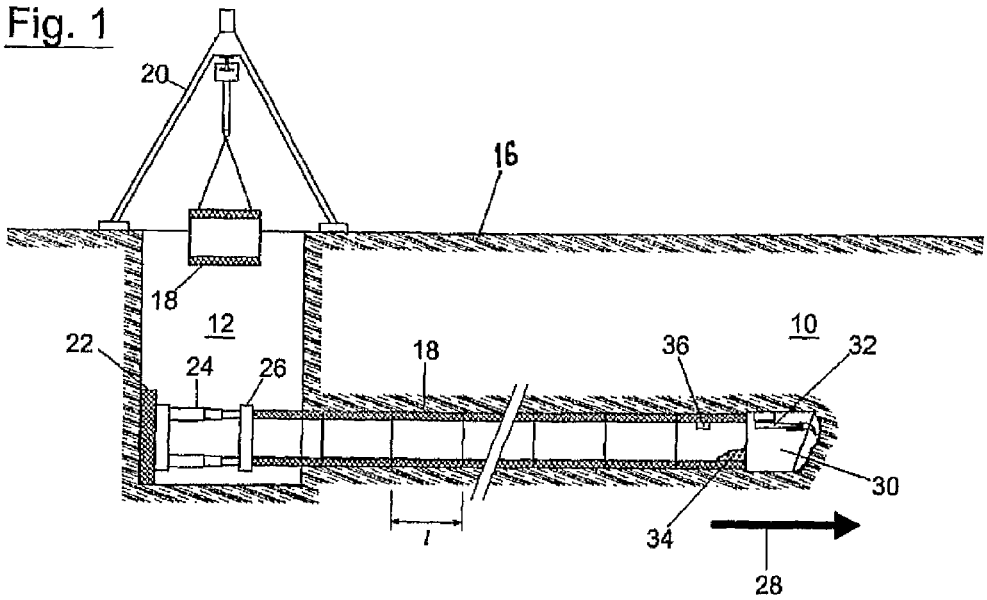

The invention concerns a method for determining the propulsion force, its eccentricity in relation to the neutral axis and/or the advance direction on advance of pipe elements to produce a longitudinal structure in a soft, stony and/or rocky ground, using a pressing device and on the faces fluid-filled expansion elements arranged in the joints of the pipeline. Furthermore, the invention concerns a method for controlling the propulsion force, eccentricity and advance direction, and the use of the method.

Conventional pipelines are laid in trenches where they are laid piece by piece in a bed, sealed and covered.

In territory which is built over, sectioned or otherwise difficult in the upper sector, known alternatives are available for driving a pipeline in the ground from a sunk shaft. A nominal route for the pipeline is planned that is as straight as possible, any obstacles being bypassed in a curve of maximum radius.

The pipeline is pressed into the ground by successive laying of pipe elements, a controllable header piece pointing the way. The new pipe elements are lowered into a pressing shaft and driven forwards by a pressing device until the next pipe piece can be inserted. The pipe elements have a diameter of up to several metres, a pipeline of pipe elements of for example 1 to 4 m diameter can reach a length of 1 to 2 km.

In a target shaft the header can be removed from the pipeline and the necessary termination devices and lines can be added.

As the advance lengths increase, the propulsion forces required increase due to the casing friction of the pipe elements. Depending on the length of the pipeline and the pressing force to be applied, intermediate pressing stations or shafts for further pressing devices can be produced with which the range can be extended accordingly.

The earth removed by the cutting head must be extracted in the opposite direction to the usually horizontal pipe advance, this can be done in the known manner with conveyer belts, rubble trolleys or similar. Furthermore with appropriate earth, thin stream transport in closed pipes is possible.

The high propulsion forces must be transmitted from pipe element to pipe element as evenly as possible and without local concentration of stresses on the face, which in direct contact would not be possible without damage. It is known to insert pressure transmission rings of wooden materials corresponding to the pipe cross-section.

During the pressing advance the pipe elements are under great stress in both axial and radial direction. The propulsion forces must overcome the frontal resistance and the friction between the pipe casing and the earth. Direction corrections, as well as increasing the propulsion forces, lead above all to an uneven distribution of pressure stresses on the pipe faces and in the pipe element itself. Further effects e.g. secondary bending forces and inherent weight, also load the pipes in the radial direction.

CH 574023 A5 describes a joint seal for a pipeline which is produced in the pressing system. Between the faces of the individual pipe elements is arranged an expansion element which forms a closed cavity. This can be expanded with pressurized filling medium so that the faces of the adjacent construction elements are pushed apart.

The inventors have faced the object of creating a method of the type cited initially with which at least one of the three parameters of propulsion force, eccentricity in relation to the neutral axis and advance direction, are determined optimally and can be optionally stored and/or used for process control.

With regard to determining the parameters, the object is achieved according to the invention in that in at least a part of the expansion elements which are distributed over the entire length of the pipeline, the fluid pressure and/or deformation of the joints is measured, and from these parameters the propulsion force and eccentricity are calculated and the values stored and/or compared with stored standard values. For process control in at least a part of the expansion elements which are distributed over the entire length of the pipeline, the fluid pressure and/or deformation of the joints is measured, and from these parameters the propulsion force and eccentricity are calculated and the values converted into control commands for the pressing device and/or the individual fluid supply to or individual fluid discharge from the expansion elements. Special and further refinements of the method are the subject of dependent claims.

With the method according to the invention, complete construction documentation, reproducible at any time, can be recorded and produced.

The records can also be used for quality control which can be implemented qualitatively and quantitatively. Furthermore the construction progress can be compared at any time with the planned nominal value for the pipeline.

On deviations, continuous process control, the variant according to the present invention, can be implemented at any time until the prespecified standard values again comply with the nominal values for the projected pipeline. This is achieved in the sense of rolling planning of the process.

Evidently both processes according to the invention, determination of the parameters and their control, can proceed simultaneously.

The English term "fluid" has become common in German to indicate a flowable medium, in particular a gas, a fluid of high or low viscosity, a gel, a pasty mass or similar.

Preferably in each joint is arranged an expansion element with a measurement device. Whereas—as stated—an expansion element must be arranged in each joint, the measurement elements can be partially omitted, preferably periodically. For example a measurement device for pressure can be provided in every 2nd, 3rd, 4th, . . . nth expansion element. Evidently a regular arrangement is not compulsory but advantageous. In the same or different joints the deformation can be measured, this usually comprising measurement of the expansion of the joint. However, shear deformation and/or other parameters which are known in themselves can also be measured. This is preferably performed at least on three points distributed regularly over the periphery, so in the case of expansion measurement the geometry of the expansion plane of a joint can be determined.

The fluid pressure in the expansion elements is suitably measured by means of a manometer. If on the basis of the parameters measured, the fluid pressure is found to deviate from the nominal value, a corresponding command controls a supply or discharge of fluid or the propulsion force is increased or reduced accordingly. The control commands can be given individually to a specific actuator but can also be given to several actuators in groups.

The expansion element can assume any geometric form in relation to cross-section. In the simplest case it is circular. The cross-sectional form can however also be square, rectangular, with the same or different wall thicknesses. Suitable materials are resilient materials which can also be fibre-reinforced and their mechanical properties can be adapted to the object-specific forces and geometric conditions.

Expansion elements that are circular, oval, elliptical or rectangular in cross-section have the geometric property that on stress-free pre-compression of the expansion elements, their contact widths on the pipe faces are only slightly dependent on the compression occurring under force. This means that even with very oblique expansion planes in the joints, the specific forces transmitted by the expansion elements along the pipe periphery vary only slightly and hence the eccentricity of the propulsion force in relation to the neutral axis of the pipes remains low, which is in great contrast to the joints of wooden materials previously normally used.

Furthermore, the ratio of force exerted K1 to force permitted K2 can be monitored by periodic or continuous calculation of the ratio. If the ratio reaches or exceeds 1 an alarm is triggered automatically and/or a display shown at the point concerned, so the operator can intervene immediately.

Figure 2:
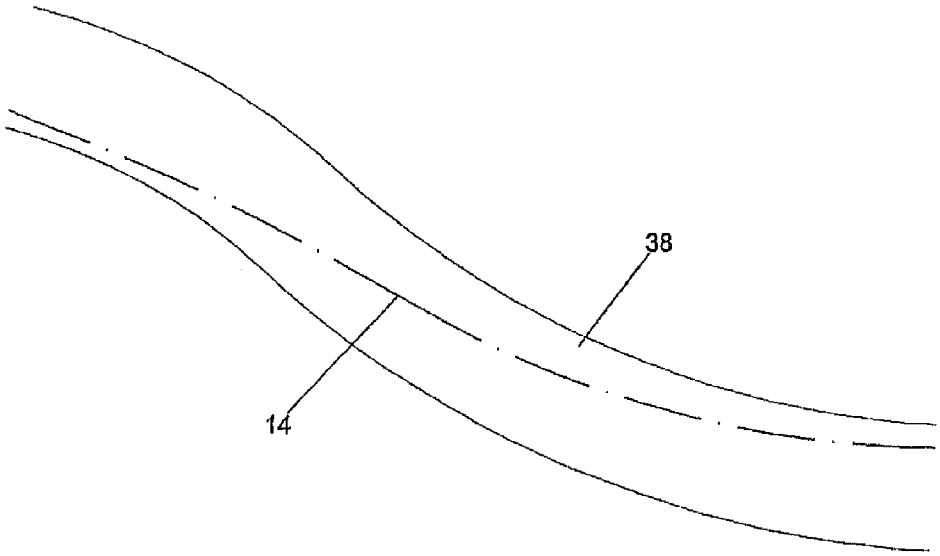
Figure 3:
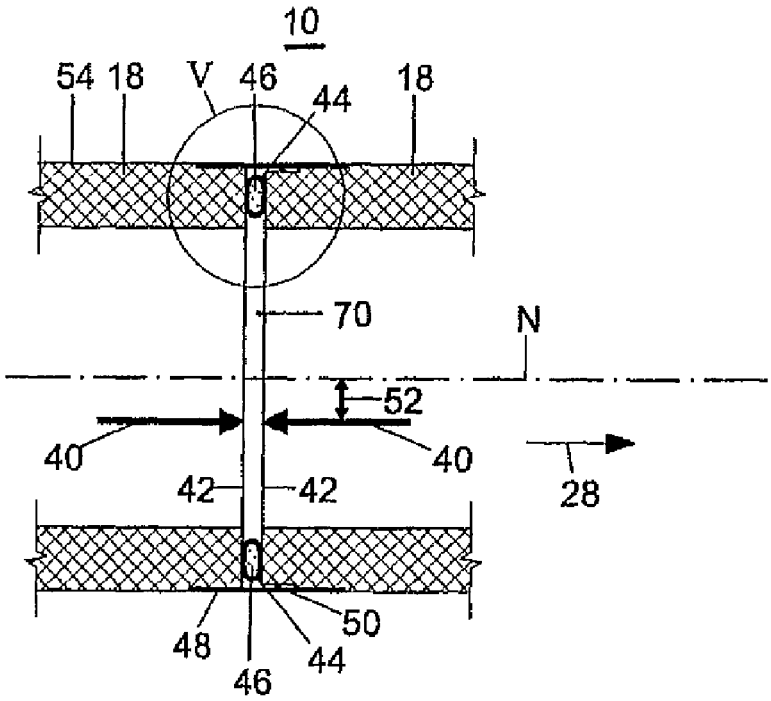
Figure 4:
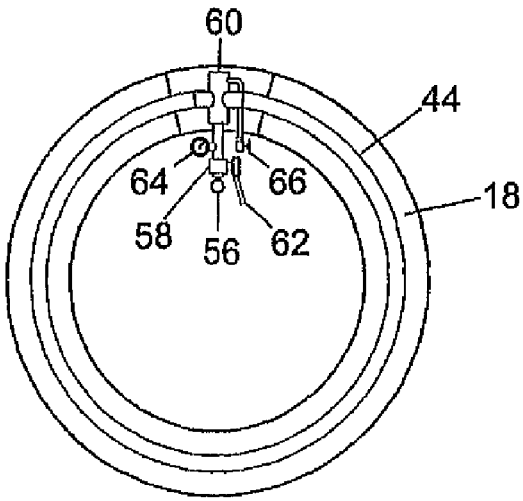
Figure 5:
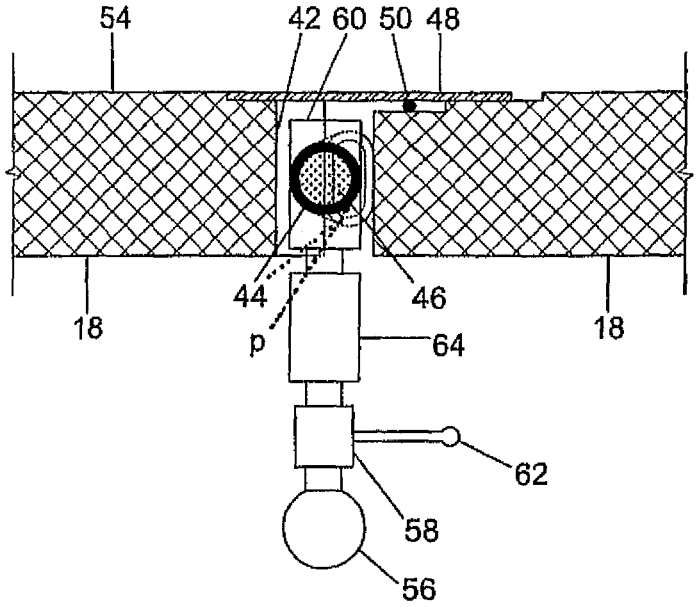
Figure 6:
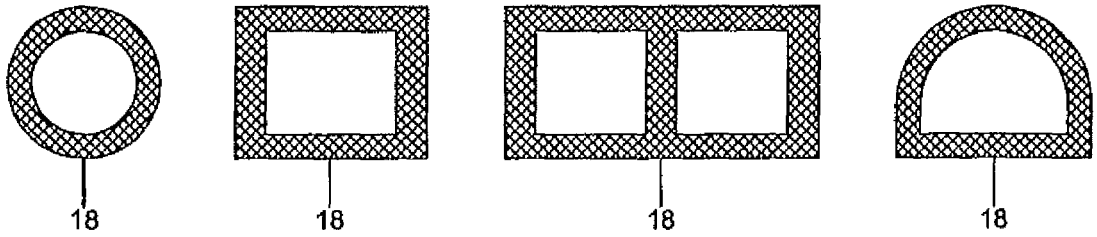
Figure 7:
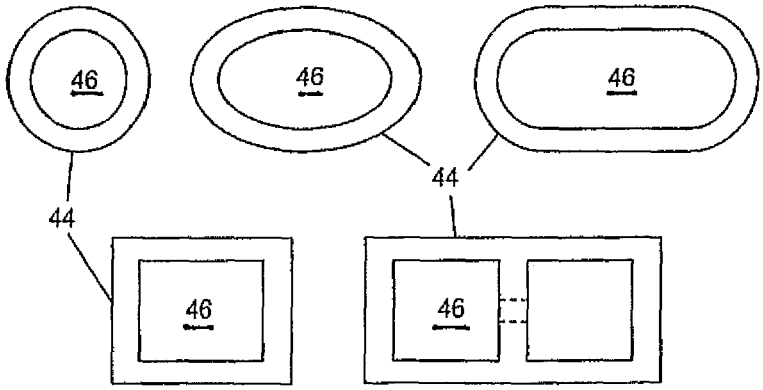
Figure 8:
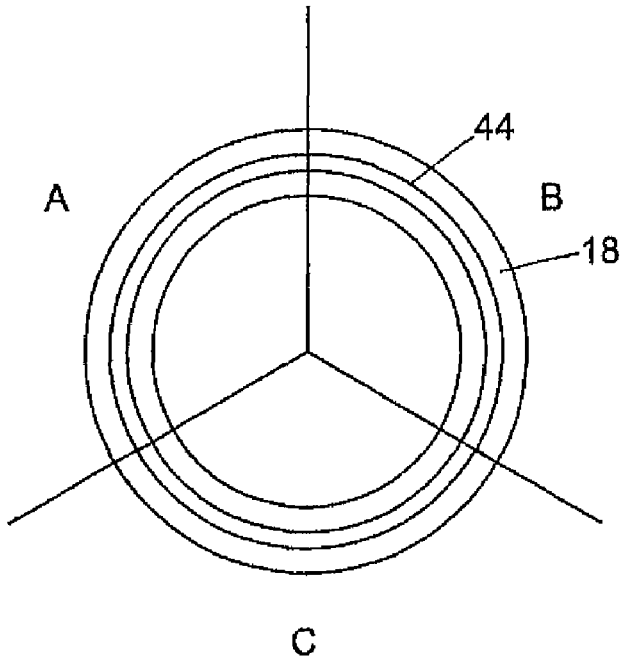
Figure 9:
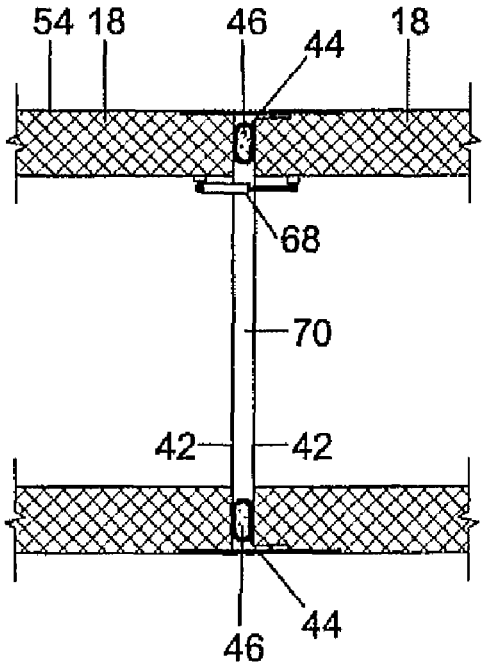

Finally, in the pressing shaft the expansion element inserted between the last pipe element of the pipeline and the new pipe element is preferably pre-compressed and the measured parameters stored. In other words on pre-compression, the geometric cross-section of the expansion element is established. As with all other measurements analysis preferably takes place in real time i.e. without time delay. The invention, in particular the necessary devices, are described in more detail below with reference to embodiment examples shown in the drawing which are also the subject of dependent claims. The drawings show diagrammatically:

FIG. 1 a vertical section through a pressing shaft with a pipeline,

FIG. 2 the course of the pipeline below a road section,

FIG. 3 an axial section through two pipe elements lying adjacent at their faces, FIG. 4 a radial section through an expansion element, FIG. 5 a detail of a butt joint of two pipe elements with a measurement and filling device according to V in FIG. 3, FIG. 6 various cross-sectional forms of pipe elements, FIG. 7 various cross-sectional forms of expansion elements, FIG. 8 a variant of FIG. 3 with sectorial sub-division of the expansion element, and FIG. 9 a variant according to FIG. 3 with expansion measurement.

In the ground 10, from soft earth through to monolithic rock, a pipeline 14 is advanced starting from a pressing shaft 12 and running at a depth of a few metres approximately parallel to the ground surface 16. The individual pipe elements 18 are lowered into the pressing shaft 12 by means of a lifting device 20.

A pressing device 24 resting on an abutment 22 is aligned to the pipeline 14. In the present case this is a hydraulic press, but pneumatic presses or lifting spindles can also be used. A pressure ring 26 presses the rear pipe element 18 on its face and pushes the entire pipeline 14 in the advance direction 28 forwards by the length l of a pipe element 18. The pressure ring 26 is then retracted, a new pipe element 18 inserted and positioned precisely with an intermediate expansion element 44 (FIG. 3). It is then advanced by a further pipe length l.

At the same time as pressing the pipeline 18 into the ground 10, a header piece 30 extracts the expelled earth in the known manner. This is achieved for example by an integral excavator 32, a cutter or another working tool known in mining. By way of a conveyor belt which is not shown the extracted earth 34 is transported in the direction of the pressing shaft 24 i.e. against the advance direction 28.

As stated the advance takes place in steps. A step comprises the insertion of a pipe element 18, the propulsion of the pipeline 14 by the length l of the pipe element 18 in the advance direction 28. The propulsion force 40 (FIG. 3) is transmitted from pipe element to pipe element 18 by way of the expansion elements 44 shown below (FIG. 3).

As stated the pipeline 14 usually runs approximately parallel to the ground surface 16. The pipeline 14 can however also run at any other angle.

For various reasons during advance of a pipeline 18 eccentricity can occur as shown in detail in FIG. 3.

The header piece 30 usually has a location device 36 so the position can be established at any time and any necessary corrections made. Furthermore, if any repair or replacement of the header piece 30 is required, an auxiliary shaft can be sunk with precision.

FIG. 2 shows an S-piece of a road 38 with pipeline 14 below. The pipeline 14 is guided through the S-piece with maximum bending radius, the projected route runs as straight as possible. By measurement and process control according to the present invention, the pipeline 14 can largely follow the projected route.

FIG. 3 shows the faces 42 of two pipe elements 18 on which a propulsion force 40 is exerted. The two faces 42 of the pipe elements 18 are joined by an expansion element 44 formed as a hollow profile. The cavity of the expansion element 44 is filled with a pressure-resistant fluid 46, the pressure P can amount to far more than 100 bar.

The connecting area of the two pipe elements 18 is covered with a sleeve 48 which has a guide and seal function. The seal function is supported by an inserted O-ring 50.

During advance of a pipeline 14 of pipe elements 18, eccentricities 52 can occur in the propulsion force 40 in relation to the neutral axis N of the pipeline 14. The reasons for this lie in the different friction conditions along the contact surface 54 of the pipe elements 18 and the ground 10, mainly however in the planned and unforeseen control movements and dimensional inaccuracies in the pipe elements 18, in particular on use of joint elements of wooden materials which have a pronounced non-linear, irreversible load deformation characteristic. The said eccentricities 52 generate torques about axes which lie in a plane standing perpendicular to the advance direction 28. To achieve equilibrium the mobilisation is required of torques running counter to these moments and of approximately equal amount by earth pressures acting at right angles to the advance direction 28. These earth pressures constitute significant loads which in extreme cases can lead to a breakage of pipe elements 18.

According to the invention all cavities of the expansion elements 44 are connected over the entire pipeline 14 by way of a pressure line 56 as shown in FIGS. 4 and 5. This pressure line 56 is connected by way of a filler valve 58 with the fitting 60 of each connected expansion element 54. The filler valve 58 can be opened with a lever 62. The fitting 60 is also fitted with a pressure meter 64 and a purge valve 66 by way of which surplus fluid in the interior of the pipeline 14 can be drained.

In the embodiment according to FIG. 4 the expansion element 44 is formed hose-like from an elastomer. The peripheral hose has no division into sections. The pressure therefore, except for the geodetic differences, is always equal all round even at maximum pressure application, as indicated in FIG. 5 with a dotted, deformed expansion element 44.

FIG. 6 shows some possible cross-sections of pipe elements 18. These can for example be round, square, rectangular, rectangular with a transverse wall or curved. The elements have a diameter or corresponding linear mass of one or more metres. They comprise for example concrete, reinforced concrete or metal.

FIG. 7 shows cross-sections of expansion elements 44. These are circular, square, elliptical, oblong rounded, cassette-like and convex both sides. There is a wide variety of possible cross-sections and the walls can be partly reinforced.

In the embodiment according to FIG. 8 the peripheral expansion element 44 is divided into three sections A, B, C of equal size which are not connected together hydraulically. Each section of the expansion element 44 can have a filling with a filler valve 58 and a drain valve 66. An active direction change can take place. With an expansion element 44 according to FIG. 8, with corresponding arrangement, the guide head 30 (FIG. 1) can be controlled directly. Normally there are three to six sectors.

In the embodiment according to FIG. 9 the expansion between the faces 42 of the pipe elements 18 is measured using an expansion meter 68.

The measurement data for pressure and deformation, in particular expansion, is administered in or outside the pipeline 18 using a processor. The filler valve 58 and purge valve 66 can also be controlled by way of corresponding actuators by a processor. The data is transmitted from and to the processor by way of electrical or optical cables or by radio, also using the Internet. These conventional electronic components are not shown for the sake of clarity.

However it is of essential significance that the cavities of all actuatable expansion elements 44 can be connected together communicating by way of the pressure line 56. The pressure line 56 extending in the inferior of the pipeline 14 over the entire length can be connected with all expansion elements 54 or just some thereof. Through the filler valve 58 the cavity of an expansion element 44 is suitably filled with a pressure-resistant fluid 46 before application of the propulsion force 40, and at the same time purged through at least one purge valve 66. By way of these two valves 58, 66 it is also possible to measure the existing internal pressure of the fluid 46 with a pressure meter 64. Using at least three local measurements of the expansion of joints 70 in the advance direction 28, the expansion plane in a Joint 70 can be determined. From the parameter pressure of the fluid 46 obtained and the geometry of the expansion plane in the Joint 70, the size and eccentricity 52 of the resulting propulsion force 40 for the described Joint function can be determined in location and amount using a reversible load deformation law. From this again the size and direction of the earth pressures transverse to the neutral axis N can be determined and hence knowledge obtained on the size of the risk of damage or even breakage of the pipe element 18 in the transverse direction. This gives a reliable and precise method of monitoring and controlling the propulsion forces 40, which can be achieved with simple, economic and robust means. The Joint 70 in a variant which is not shown can also be concentric, spiral or have a complicated geometry which does not generate any transverse forces.

By compression of the expansion element 44 in the joint 70 while the filler valve 58 and/or purge valve 66 are opened, and hence the fluid 46 can freely enter and escape from the cavity of the expansion element 44, the expansion element 44 is deformed without the pressure in the cavity of the expansion element 44 changing. Due to such pre-compression the force-transmitting contact surface of the expansion element 44 on the face 42 of the pipe element and hence also the propulsion force 40 can be increased. With targeted pre-compression therefore the deformation behaviour of the expansion element 44 can be controlled within certain limits according to requirements.

The expansion elements 44 which are divided into several parts, i.e. sectioned, constitute independent hydraulic vessels which can have different internal pressures. The only common parameter of these sections is the geometry of the expansion plane. By controlling the pressure or the quantity of fluid 46 present in the cavity of the individual sections of the expansion element 44, the position of the resulting propulsion force 40 is influenced in location and amount. With targeted use of this property, the divided expansion element 40 can serve to control and monitor precisely the position and size of eccentricity 52 of the propulsion force 40.

If these sub-divisions are omitted for an expansion element 44, the fluid pressure P in the cavity of the expansion element 44 is the same throughout and the size of the force transmitted by way of the expansion element 44 per unit length of the expansion element 44 measured in the peripheral direction is dependent only on the size of the contact width of the expansion element 44 on the faces of the is elements, and in particular independent of the other geometry of the expansion element 44. With a suitable choice of properties and geometry, and pre-compression of the expansion element 44, the dependency of the face-side joint contact surfaces per unit length on the compression of the expansion element 44 can be kept low. Thus the eccentricity 52 of the resulting propulsion force 40 can be made independent of the expansion of expansion element 44 or kept within narrow limits. This constitutes a significant improvement in the properties of the expansion element 44 described.

After advance, there are in essence two possibilities for re-use of the expansion element 44 described:

- the internal pressure of the expansion element 44 is reduced and this is removed from the interior of the completed construction. This allows re-use of the expansion element 44.
- the expansion element 44 remains fitted and is re-used as a construction seal for the end state.

The pressure of the fluid 46 within the expansion element 44 is monitored and controlled further and hence the sealing effect of the expansion element 44 can be controlled.

The fluid 46 in the expansion element can be replaced with a hardening fluid, for example a cement suspension. This is pressed under a particular pressure into the cavity of the expansion element 44 and after hardening used for permanent pretension and sealing pressure.

To summarise it can be found that according to the invention it is possible, with the described construction of the expansion element 44, to bridge or pretension the entire construction in a simple manner with all the associated advantages.

The invention claimed is:

1. A method for determining propulsion force that is effective in a predetermined pipe element of a pipeline in a process for laying a pipeline into the ground by laying successive pipe elements including a most rearward pipe element at one end and a controllable header piece at the other end and advancing the pipe elements in a predetermined direction by means of a pressing device resting on an abutment, wherein the most rearward pipe element is pressed by the pressing device to advance it and the entire pipeline stepwise, pressing the most rearward element in the predetermined direction until a next pipe element can be inserted, then retracting the pressing device and inserting a new pipe element as the most rearward pipe element and driving it in the predetermined direction with said pressing device, repeating the above sequence until a last pipe element is advanced, comprising the steps of:

a) aligning a plurality of pipe elements including said predetermined pipe element end-to-end to form a pipeline, wherein the most rearward pipe element is located to receive a pressing force applied to it by a pressing device resting on an abutment for pushing the entire pipeline in the advance direction by a length of at least one pipe element, b) measuring a fluid pressure in an expansion element in the form of a hollow profile provided in a joint between said predetermined pipe element and a further pipe element, said hollow profile being filled with a pressure-resistant fluid, c) measuring a deformation of said joint by at least three local expansion measurements, d) calculating geometric data of an expansion plane of said joint from said at least three local measurements, and e) determining size and eccentricity of the propulsion force for advance of the entire pipeline in relation to a neutral axis or to an advance direction from said measuring of the fluid pressure and from the geometric data of the expansion plane.

2. A method for producing a pipeline comprised of a plurality of pipe elements including a first and a second pipe element in ground, comprising the steps of:

a) providing a pressing device resting on an abutment and pushing the entire pipeline in an advance direction to advance the entire pipeline by a length of one pipe element by exerting a pressing force on the most rearward pipe element to thereby advance the entire pipeline, b) providing an expansion element in the form of a hollow profile in a joint between said first and a said second pipe element of the pipeline, said hollow profile being filled with a pressure-resistant fluid, c) measuring a fluid pressure in said hollow profile, d) measuring a deformation of said joint by at least three local expansion measurements, e) calculating geometric data of an expansion plane of said joint from said at least three local measurements, f) determining size and eccentricity of a propulsion force that is effective in said pipe element during advancing said entire pipeline comprised of said plurality of pipe elements, said size and eccentricity being determined in relation to a neutral axis or to an advance direction from said measuring of the fluid pressure and from the geometric data of the expansion plane.

3. A method according to claim 1 or 2, further comprising the step of:

a) providing an expansion element in the form of a hollow profile in each joint between consecutive first and second pipe elements of the pipeline, said hollow profile being filled with a pressure-resistant fluid, and b) measuring the deformation in each joint.

4. A method according to either of claim 1 or 2, characterized in that said expansion element is divided into sections and the fluid pressure of each section is measured and individual fluid quantities are supplied to or extracted from sections by control command corresponding to the fluid pressure measured for the sections.

5. A method according to claim 4, characterized in that a header piece is controlled with a front expansion element.

6. A method according to either of claim 1 or 2, characterized in that the fluid pressure is measured in said expansion element which in cross-section is circular, oval, elliptical or round in the direction of at least one face of the pipe.

7. A method according to either of claim 1 or 2, characterized in that the ratio of force exerted on pipe elements by the expansion element to force permitted for said pipe elements is calculated and monitored periodically or continuously, and when $$\frac{K_1}{K_2} \geq 1$$

an alarm is triggered, wherein $K_1$=force exerted and $K_2$=force permitted.

8. A method according to either of claim 1 or 2, characterized in that parameters are measured on pre-compression of the expansion element and the measured values of the parameters are stored.

9. A method according to either of claim 1 or 2, characterized in that calculation of values and comparing with stored values or converting into control commands take place in real time.

10. A quality control method comprising: performing the steps according to claim 1 to obtain records, qualitatively or quantitatively evaluating the records and implementing quality control based on the evaluation.

11. A method according to claim 2, comprising the step of: comparing said size and eccentricity of the propulsion force with stored standard values to avoid a risk of damage of pipe elements.

12. A method for determining propulsion force that is effective in a predetermined pipe element of a system for laying a pipeline into the ground by laying successive pipe elements including a most rearward pipe element at one end and a controllable header piece at the other end and advancing the pipe elements in a predetermined direction by means of a pressing device resting on an abutment, wherein the most rearward pipe element is pressed by the pressing device to advance it and the entire pipeline stepwise, pressing the most rearward element in the predetermined direction until a next pipe element can be inserted, then retracting the pressing device and inserting a new pipe element as the most rearward pipe element and driving it in the predetermined direction with said pressing device, repeating the above sequence until a last pipe element is advanced, the system comprising:

a) a pressing device resting in a pressing bay on an abutment;

b) several pipe elements in front of the pressing device with respect to a direction of pipe element advancement, namely the rear-most pipe element in front of said pressing device and further pipe elements in front of said rear pipe element, c) a hollow, hose pressure transmitting element in a joint between two pipe elements of said several pipe elements, said hollow pressure transmitting element being filed with a pressure-resistant fluid, d) a filling valve connected to the pressure transmitting element, the filling valve being closed during advancement of the entire pipeline of several pipe elements by said pressing device, e) a pressure measurement device for measuring fluid pressure in said pressure transmitting element during propulsion, f) a deformation measurement device for measuring at least three local expansions of said joint during propulsion, wherein the method comprises the following steps:

g) providing control commands to the pressing device, wherein said control commands define an actual propulsion force that is sufficient to advance all of the several pipe elements at once, h) applying said actual propulsion force by the pressing device to said rear-most pipe element wherein the propulsion force is transmitted at once along the several pipe elements from pipe element to pipe element and is resulting in an exerted force at said joint, i) measuring the fluid pressure in said hollow hose pressure transmitting element of said joint during advancement of the several pipe elements by the pressing device, j) measuring the deformation of said joint during advancement of the several pipe elements, k) calculating geometric data of a pressure transmitting plane of said joint from said at least three local expansion measurements, l) determining size and eccentricity of the exerted propulsion force that is effective in said joint during advancement of said entire pipeline, said size and eccentricity being determined—in relation to a neutral axis (N) or to an advance direction—from said measuring of the fluid pressure and from said geometric data of the pressure transmitting plane.

13. A method for producing a pipeline of pipe elements in ground by laying successive pipe elements including a most rearward pipe element at one end and a controllable header piece at the other end and advancing the pipe elements in a predetermined direction by means of a pressing device resting on an abutment, wherein the most rearward pipe element is pressed by the pressing device to advance it and the entire pipeline stepwise, pressing the most rearward element in the predetermined direction until a next pipe element can be inserted, then retracting the pressing device and inserting a new pipe element as the most rearward pipe element and driving it in the predetermined direction with said pressing device, repeating the above sequence until a last pipe element is advanced, comprising the steps of:

a) providing a pressing device resting on an abutment in a pressing bay, b) providing several pipe elements arranged in front of the pressing device and between the pressing device and a header piece of the pipeline, namely the rear-most pipe element in front of said pressing device and further pipe elements in front of said rear pipe element, c) providing a hollow, hose pressure transmitting element in a joint between two pipe elements of said several pipe elements, said hollow pressure transmitting element being filed with a pressure-resistant fluid, d) providing a filling valve connected to the pressure transmitting element, e) the filling valve being closed during advancement of the entire pipeline of several pipe elements by said pressing device, f) providing control commands to the pressing device, wherein said control commands define an actual propulsion force that is sufficient to advance all of the several pipe elements at once, g) applying said actual propulsion force by the pressing device to said rear-most pipe element generating simultaneous advancement of the several pipe elements in the advance direction by transmission of the propulsion force from pipe element to pipe element and resulting in an exerted propulsion force at said joint, h) measuring a fluid pressure in said hollow hose pressure transmitting element of said joint during simultaneous advancement of the several pipe elements by the pressing device, i) measuring a deformation of said joint by at least three local expansion measurements, j) calculating geometric data of a pressure transmitting plane of said joint from said at least three local expansion measurements, k) determining size and eccentricity of the exerted propulsion force that is effective in said joint during advancement of said entire pipeline, said size and eccentricity being determined—in relation to a neutral axis (N) or to an advance direction—from said measuring of the fluid pressure and from said geometric data of the pressure transmitting plane, l) controlling said propulsion force of the pressing device depending on said determined size and eccentricity of the propulsion force and triggering an alarm if the exerted propulsion force that is effective in said joint exceeds the permitted propulsion force for the determined size and eccentricity of the propulsion force.

14. Method according to claim 13, comprising the step of pushing the entire pipeline of several pipe elements in the advance direction by a length of at least one pipe element and inserting a new rear pipe element.

* * * * *